United States Patent [19]

Brookes

[11] 4,388,753

[45] Jun. 21, 1983

[54] METHOD OF LOADING RIVETS

[75] Inventor: David J. Brookes, Sutton Coldfield, England

[73] Assignee: USM Corporation, Farmington, Conn.

[21] Appl. No.: 255,316

[22] Filed: Apr. 17, 1981

[30] Foreign Application Priority Data

May 3, 1980 [GB] United Kingdom ..... 8014919

[51] Int. Cl.[3] ..... B23P 19/04; B21D 9/05

[52] U.S. Cl. ..... 29/433; 72/391

[58] Field of Search ..... 72/391; 206/338, 340, 206/347; 29/433, 241; 414/27

[56] References Cited

U.S. PATENT DOCUMENTS

| | | | |
|---|---|---|---|
| 2,706,039 | 4/1955 | Springate | 206/338 |
| 3,211,293 | 10/1965 | Tarnoff | 206/493 |
| 3,286,856 | 11/1966 | Greenlay et al. | 414/27 |
| 3,773,169 | 11/1973 | Zahuranec et al. | 29/241 |
| 3,946,884 | 3/1976 | Kato et al. | 414/27 |
| 4,128,155 | 12/1978 | Gerhart | 414/27 |

FOREIGN PATENT DOCUMENTS 1343 7/1979 European Pat. Off. .

*Primary Examiner*—Ervin M. Combs
*Assistant Examiner*—Steven E. Nichols
*Attorney, Agent, or Firm*—Alan N. McCartney

[57] ABSTRACT

A method of loading a column of hollow rivets on to a mandrel for use in blind-riveting. The rivets are provided assembled head-to-tail on a strand made of resilient plastics material. The strand may be tubular or have at least a hollow end portion and be connected to the mandrel by being pushed on to a reduced end portion of the mandrel so that the strand grips the mandrel and the rivets are slid off the strand and on to the mandrel.

1 Claim, 3 Drawing Figures

METHOD OF LOADING RIVETS

BACKGROUND OF THE INVENTION (1) Field of the Invention

This invention is concerned with a method of loading rivets and in particular it is concerned with a method of loading a column of hollow rivets for use in pull-through-blind-riveting on to a long-stemmed headed mandrel.

(2) Prior Art

In one kind of well-known blind-riveting system (that is to say, a fastening system whereby a hollow rivet can be set in aligned holes in superposed parts of a workpiece from one side only of the workpiece), a column of 30 to 60 rivets, may, depending on their length, be assembled with the rivets head-to-tail on a mandrel which, at the tail end of the foremost rivet, there is a setting head. The mandrel is inserted in a blind-riveting tool which has means for gripping the mandrel at its rearward end and moving it back and forth, a split nosepiece which can abut the head of the foremost rivet and hold it against the accessible face of the workpiece while the mandrel is pulled through the rivet to set it, and means for urging the rivets forward after each setting stroke so as to project the foremost one through the nosepiece and up to the mandrel head ready for the next riveting operation. This kind of blind-riveting system will be referred to hereinafter as "pull-through blind-riveting".

A mandrel for use in pull-through blind-riveting has to be of high quality to ensure that it is strong enough not to break while yet it is thin enough to be accommodated in the bores of the rivets, and is therefore an expensive item which requires its repeat use over and over again rather than dispense with it after setting one column of rivets. Accordingly, it is necessary to load it with a fresh column of rivets when one has been used up.

U.S. Pat. Nos. 4,338,714 granted July 13, 1982 and 4,346,804, granted Aug. 31, 1982 describe a method and an apparatus of loading hollow rivets on to a headed mandrel so that they can be set in a pull-through blind-riveting operation where the method as described is preferably carried out by threading the mandrel right through a sleeve on which there is a column of hollow rivets assembled head-to-tail and transferring the rivets to the mandrel while withdrawing the sleeve. This method although a great improvement over previous methods requires the mandrel to be thin enough to be threaded through the sleeve; this results in a weaker mandrel than may be desirable, since strength is an important necessity for such mandrels, and in the rivets not being held centrally on the mandrel. Other disadvantages of this method lie in the fact that the wall of the sleeve has to be thin and made to very close tolerances; such sleeves may not be readily available in inexpensive materials.

It is an object of the present invention to provide an improved method of loading hollow rivets on to a headed mandrel which method avoids the above-mentioned disadvantages.

BRIEF SUMMARY OF THE INVENTION

The invention provides a method of loading a column of hollow rivets on to a long-stemmed headed mandrel for use in blind-riveting wherein a column of rivets is provided assembled head-to-tail on a strand made of resilient plastics material, bringing together end portions of the mandrel and strand and causing them to assume a gripping engagement one within the other, and then sliding the rivets tail first off the strand and on to the mandrel.

The gripping engagement one within the other between the strand and the mandrel may, in carrying out such a method, be achieved in such a manner that the rivets will pass over the connection by providing an axial bore in the one inserting into it an end portion of the other, the axial bore being preferably provided in the strand and the end portion of the mandrel stem being of reduced cross section not less than, and preferably slightly greater than, that of the bore. With the strand made of resilient plastics material (e.g. polypropylene) the hollow end portion tends to be axially compressed, and thus to expand radially, to admit the end portion of the mandrel and to stretch axially and consequently contract radially to grip the mandrel if the mandrel tends to pull away. Such an axial bore is preferably provided at each end of the strand so that it does not matter which way round on the strand the rivets are assembled. Reducing the cross section of the end portion of the mandrel stem means that the strand can be of the same diameter as the mandrel stem. The strand may be solid with an axial bore at one or both ends or may be in the form of a sleeve, in which case the wall thickness is not critical provided its inner diameter is such as to enable the end portion of the mandrel to be gripped.

The tail end portion of the mandrel, in the case where it is to be inserted in a hollow end portion of the strand, may be cylindrical and reduced in diameter from that of the remainder of the mandrel stem, or may taper towards its tip.

BRIEF DESCRIPTION OF THE DRAWINGS

There now follows a detailed description, to be read with reference to the accompanying drawings, of a method illustrative of the invention of loading a column of hollow rivets on to a mandrel stem. It is to be understood that this illustrative method has been selected for description of the invention by way of example and not of limitation.

In the accompanying drawings.

DESCRIPTION OF THE PREFERRED EMBODIMENT

Figure 1:
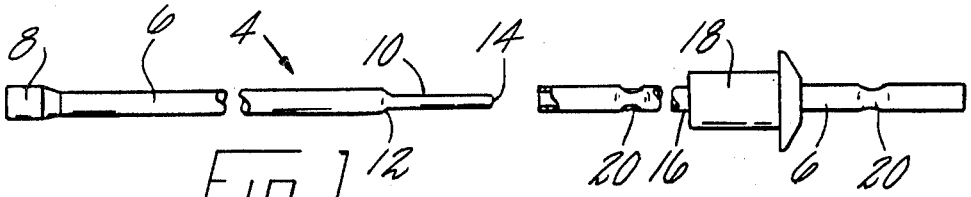
FIG. 1 is a side elevational fragmentary view of a mandrel and a column of rivets assembled head-to-tail on a strand.

FIG. 1 shows a mandrel 4 which has a long stem 6 and a head 8 which is pulled through rivets assembled on the stem 6 in order to set the rivets. The stem 6 is substantially cylindrical and has a tail end portion 10, remote from the head 8, which is of reduced diameter. The reduced tail end portion 10 is connected to the remainder of the stem 6 by a tapering portion 12 of the stem and has a tapering end portion 14 at the free end thereof.

FIG. 1 also shows a strand 16 made of resilient plastics material, in this case polypropylene, and having a column of hollow rivets 18 assembled thereon by having the strand 16 threaded through them to provide a pack which holds as many rivets as one can load on the mandrel 4 and which can be readily handled and stored without the rivets falling off the strand. For this latter purpose, the strand 16 is flattened at two points adjacent its ends to provide flattened regions 20 which serve to provide resistance to the rivets 18 falling off the strand under their own weight; but the resistance caused by the regions 20 can readily be overcome by an operator applying light pressure to the rivets 18 when he wants them to pass the flattened regions.

The strand 16 used to provide the pack for carrying out the illustrative method is preferably a hollow tube with internal dimensions such that, when the tail end portion 10 of the mandrel is introduced into the strand 16, the strand 16 is caused to grip the tail end portion 10; that is to say, the internal diameter of the tubular strand 16 is substantially the same as or slightly less than the diameter of the tail end portion 10 so that, when the mandrel is pushed in, the strand tends to expand, and when the mandrel is pulled in a direction away from the strand, the strand, tending to stretch, contracts and grips the mandrel. The external dimensions of the strand 16 are substantially the same as those of the remainder of the stem 6 of the mandrel other than the reduced tail end portion 10; thus, the strand 16 has substantially the same external diameter as the diameter of the stem 6.

Whereas a tubular strand of uniform wall thickness is preferred in making the pack for use in a method in accordance with the invention, the strand can be made of solid rod of the same outside diameter, or of less diameter, provided hollow end portions are provided of similar dimensions to the wall of the tubular strand aforementioned so that they can receive and grip the reduced end portion of the mandrel in the same way. Of course, such a hollow end portion need be provided only at that end which will be connected to the mandrel in transferring the rivets, but in practice such a hollow end portion is preferable at both ends for manufacturing purposes, either to connect with part of a loading machine or merely to avoid the risk of the rivets being assembled on the strand the wrong way round.

Figure 2:
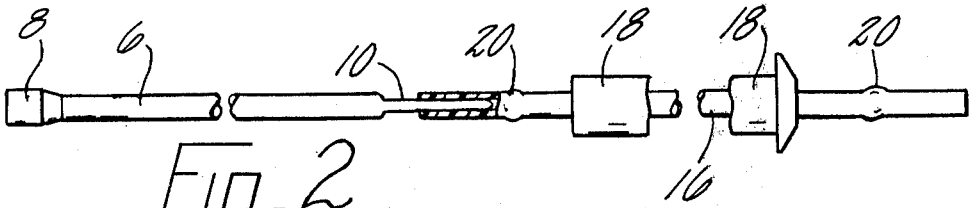
FIG. 2 is a view similar to FIG. 1 but showing the mandrel and the strand connected and rotated through 90° relative to FIG. 1.
Figure 3:
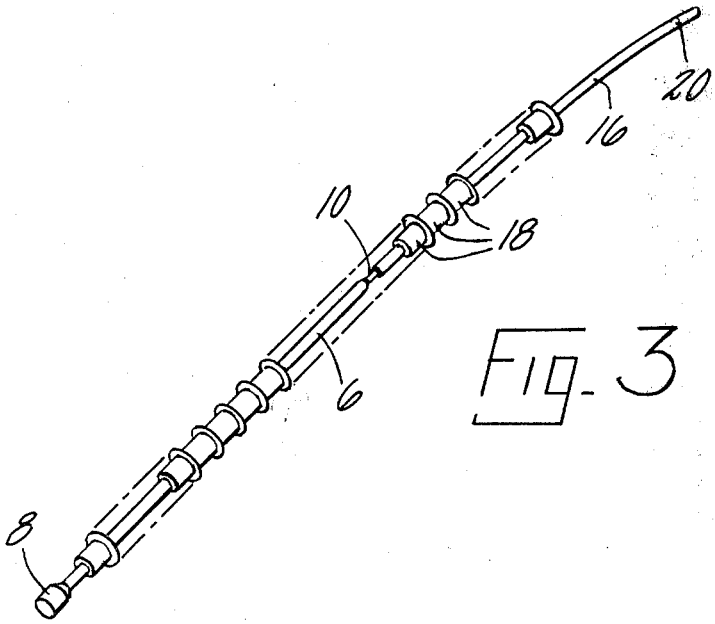
FIG. 3 is a perspective view showing rivets being transferred from the strand to the mandrel shown in FIGS. 1 and 2.

In the illustrative method, the hollow strand 16 (or hollow end portion of a solid strand) is connected to the mandrel 4 by pushing the strand 16 on to the tail end portion 10 of the mandrel 4. As the tail end portion 10 enters the strand 16, the strand 16 is in compression and expands to allow the tail end portion 10 to enter. When the pushing of the strand 16 on to the mandrel 4 ceases, the strand 16 relaxes gripping the tail end portion 10 firmly (see FIG. 2). Next, in the illustrative method, the rivets 18 are pushed so that they slide over the flattened region 20, off the strand 18 and on to the mandrel 4 (this process is shown in FIG. 3). When the rivets 18 have all been loaded on to the mandrel 4, the strand 16 can be removed from the tail end portion 10 by compressing the strand 16 where it connects with the mandrel 4 by inserting a finger nail over the end of the strand 16 and pressing towards the strand 16; this causes the strand 16 to expand releasing its grip so that the strand 16 can be removed.

Since the mandrel 4 can be gripped by jaws of a blind-riveting tool forwardly of the reduced end portions 10, the reduced end portion 10 does not reduce the operative strength of the mandrel 4. Furthermore, the diameter of the portion 10 can be chosen to suit the wall thickness of the strand 16 thereby allowing various wall thicknesses to be used, resulting in a wider choice of suitable material from which the strand can be made.

In a modification of the illustrative method, instead of being cylindrical, the reduced end portion 10 of the mandrel may taper towards its free end to allow greater flexibility in the dimensions of the strand 16.

Other materials besides polypropylene may be used for the strand 16 so long as a connection can be formed between the strand 16 and the mandrel 4.

Whereas interconnection between the mandrel and the strand by inserting the end portion of the mandrel into a hollow end portion of the strand is preferred in carrying out the invention, partly because such arrangement ensures smooth transfer of the rivets from the strand to the mandrel, the alternative of inserting the strand into a hollow end portion of the mandrel is contemplated. Such alternative arrangement would not, however, enable one to take advantage of the behavior of the plastics material of the strand to expand to admit the mandrel when connecting the strand and mandrel together and to contract and grip the mandrel when tension tends to separate them.

I claim:

1. The method of loading a column of hollow rivets onto a long-stemmed headed mandrel for use in blind-riveting wherein a column of rivets is provided assembled head-to-tail on a strand of resilient plastics material, comprising:

providing the mandrel with a reduced tail end portion with the remainder of the stem having a diameter substantially the same as that of the strand;

providing the strand with a hollow end portion at the end toward which the tail end of the rivet's face;

inserting the reduced tail end portion of the stem into the hollow end portion of the strand to securely grip the stem into the strand; and sliding the rivet's tail first off the strand onto the stem of the mandrel.

* * * * *